US008083299B2

(12) United States Patent
Funcken et al.

(10) Patent No.: US 8,083,299 B2
(45) Date of Patent: Dec. 27, 2011

(54) HOUSING FOR A FRONT-LOADING LAUNDRY APPLIANCE

(75) Inventors: Florian Funcken, Guetersloh (DE); Holger Hoppe, Beckum (DE)

(73) Assignee: Miele & Cie. KG, Guetersloh (DE)

( * ) Notice: Subject to any disclaimer, the term of this patent is extended or adjusted under 35 U.S.C. 154(b) by 397 days.

(21) Appl. No.: 11/621,210

(22) Filed: Jan. 9, 2007

(65) Prior Publication Data

US 2007/0159034 A1 Jul. 12, 2007

(30) Foreign Application Priority Data

Jan. 10, 2006 (DE) ..... 10 2006 001 437

(51) Int. Cl.
*A47G 29/00* (2006.01)

(52) U.S. Cl. ..... 312/228; 312/265.6

(58) Field of Classification Search ..... 312/228, 312/527.1, 265.5, 265.6, 257.1, 236, 100, 312/229; 134/200; 411/182, 508, 509, 913, 411/104, 522; 34/603; 68/3 R; 403/353, 403/24; 24/293, 295, 563; 361/679.02, 679.57, 361/679.58, 679.6; 220/4.02
See application file for complete search history.

(56) References Cited

U.S. PATENT DOCUMENTS 1,178,338 A * 4/1916 Niernsee ..... 135/160
2,329,648 A * 9/1943 Philipp ..... 312/236
2,551,400 A * 5/1951 Sorensen ..... 411/555
2,708,088 A * 5/1955 Steinke ..... 248/221.12
3,071,400 A * 1/1963 Bellock ..... 211/206
3,156,282 A * 11/1964 Bedford, Jr. ..... 411/103
3,288,192 A * 11/1966 Bollinger ..... 411/166
3,342,537 A * 9/1967 Nelson et al. ..... 312/100
4,103,981 A * 8/1978 Donahue et al. ..... 312/265.6
4,240,323 A * 12/1980 Kojima ..... 411/15
4,288,133 A * 9/1981 Deatherage ..... 312/279
4,325,594 A * 4/1982 Lang et al. ..... 312/100
4,454,732 A * 6/1984 Burkland et al. ..... 68/3 R
4,579,492 A * 4/1986 Kazino et al. ..... 411/80.1
4,692,987 A * 9/1987 Cuthbert et al. ..... 29/455.1
4,909,580 A * 3/1990 Mitchell ..... 312/351.3
5,114,203 A * 5/1992 Carnes ..... 296/50
(Continued)

FOREIGN PATENT DOCUMENTS

DE 28 40 939 12/1979
(Continued)

*Primary Examiner* — Darnell Jayne
*Assistant Examiner* — Timothy M Ayres
(74) *Attorney, Agent, or Firm* — Leydig, Voit & Mayer, Ltd.

(57) ABSTRACT

A housing for a front-loading laundry appliance includes a front wall including a first surface and a first and a second lateral edge each having a respective second flange extending substantially parallel to the first surface. A first lateral load-bearing member abuts the first lateral edge of the front wall and a second lateral load-bearing member abuts the second lateral edge of the front wall. A supporting element is disposed in a lower portion of the housing. A respective forwardly projecting positioning element is disposed above the first supporting element at a front end of each of the first and second lateral load bearing members and has a form of a sleeve. Each of the respective second flanges of the front wall includes a respective opening configured to receive a respective one of the positioning elements.

18 Claims, 5 Drawing Sheets

U.S. PATENT DOCUMENTS

| | | | | |
|---|---|---|---|---|
| 5,408,724 | A * | 4/1995 | Mullet et al. | 16/94 R |
| 5,584,549 | A | 12/1996 | Lybarger et al. | |
| 6,354,574 | B1 * | 3/2002 | Oliver et al. | 267/49 |
| 6,460,949 | B2 * | 10/2002 | Jung | 312/228 |
| 6,736,470 | B2 * | 5/2004 | Manke et al. | 312/228 |
| 6,971,831 | B2 * | 12/2005 | Fattori et al. | 411/508 |
| 2004/0091335 | A1 * | 5/2004 | Nagasawa et al. | 411/508 |
| 2004/0168484 | A1 * | 9/2004 | Kim et al. | 68/24 |
| 2005/0023943 | A1 * | 2/2005 | Fan et al. | 312/223.2 |
| 2005/0116591 | A1 * | 6/2005 | Hwang et al. | 312/265.6 |
| 2005/0146254 | A1 * | 7/2005 | Choi et al. | 312/279 |

FOREIGN PATENT DOCUMENTS

| | | |
|---|---|---|
| EP | 0588100 | 3/1994 |
| EP | 1424429 | 6/2004 |
| EP | 1462049 | 9/2004 |
| WO | WO-2004/011711 | 2/2004 |

* cited by examiner

HOUSING FOR A FRONT-LOADING LAUNDRY APPLIANCE

Priority is claimed to German patent application DE 10 2006 001 437.5, filed Jan. 10, 2006, which is hereby incorporated by reference herein.

The present invention relates to a housing for a front-loading laundry appliance, such as a washing machine, a washer-dryer machine, or a laundry dryer, the housing including a front wall, two opposite lateral load-bearing members, and further including at least one supporting element which is disposed in the lower portion of the housing and provides a support for fixing the front wall at its lower edge, the lateral edges of the front wall abutting the load-bearing members when in a fixed position.

BACKGROUND

A housing for a front-loading washing machine is described, for example, in EP 1 424 429 A1. This housing has hook-shaped supporting elements provided in the lower front portion thereof for supporting and fixing the front wall. In order to improve attachment to the lower cross brace, projections are disposed between two neighboring supporting elements. When the front wall is in a fixed position, said projections rest against an inwardly directed flange of the front wall and press the lower edge of the front wall more firmly against the supporting elements.

German Patent Application DE 28 40 939 A1 describes a housing having load-bearing members in the form of a bottom plate and two opposite side walls. The front wall is placed with its lower edge on supporting elements and positioned against the front edges of the side walls. In the upper portion, the front wall is attached at the lateral edges to the front edges of the side walls by means of brackets. The supporting elements are mounted on the bottom member. They extend in a forward direction and have an upwardly pointing pin. The front wall is provided with openings at its lower flange, said openings corresponding to the pins and allowing the front wall to be positioned and fixed in the lower portion.

It is described in International Patent Application WO 2004/011711 A1 to provide the front wall of a housing with pins which project into openings in the lateral load-bearing members. These pins are dimensioned such that the front wall is positioned against the front edges of the load-bearing members, so that the pins project into the openings. At the bottom side, the pins are each provided with a slot into which the edge of the opening projects when the front wall drops slightly down to the end position.

For larger appliance doors or housings, the stability of attachment turns out to be insufficient. Due to the low stability, an open appliance door may vibrate or may deform the front wall in the hinge region. Another effect is that audible vibrations may occur during operation of the laundry appliance, said vibrations being produced in regions where the front wall abuts the front edges of the side walls without being attached thereto.

European Patent Application EP 0 588 100 A1 describes a housing having a reinforced front section. At the front, a reinforcing plate is mounted between the bottom member and lateral strips, the door or the door hinge being attached to said reinforcing plate. In the area of the door, the front wall has an opening which has a larger diameter than the outer ring of the door. The front wall is positioned against the reinforcing plate, the door protruding through the opening. The front wall is screwed to the reinforcing plate using an additional ring which closes the gap between the door and the edge of the opening in the front wall. Such a construction is quite expensive because of the additional large reinforcing plate and the mounting ring. Moreover, additional measures have to be taken to prevent the side walls from vibrating at the front.

SUMMARY

It is therefore an object of the present invention to improve the housing of a front-loading laundry device of the type mentioned at the outset in terms of stability.

The present invention provides a housing for a front-loading laundry appliance. The housing includes a front wall including a first surface and a first and a second lateral edge, and, at each of the first a second lateral edges, a respective first rearwardly directed flange and a respective second flange originating at the respective first flange and extending substantially parallel to the first surface. A first and a second opposite lateral load-bearing member are included, the first lateral load-bearing member abutting the first lateral edge of the front wall and the second lateral load-bearing member abutting the second lateral edge of the front wall when the front wall is in a fixed position. A first supporting element is disposed in a lower portion of the housing and configured to provide a support for fixing the front wall at its lower edge. A respective forwardly projecting positioning element is disposed above the first supporting element at a front end of each of the first and second lateral load bearing members and includes a form of a sleeve. Each of the respective second flanges of the front wall includes a respective opening configured to receive a respective one of the positioning elements.

BRIEF DESCRIPTION OF THE DRAWINGS

An exemplary embodiment of the present invention is shown in the drawings in a schematic way and will be described in more detail below. In the drawings.

DETAILED DESCRIPTION

Figure 1:
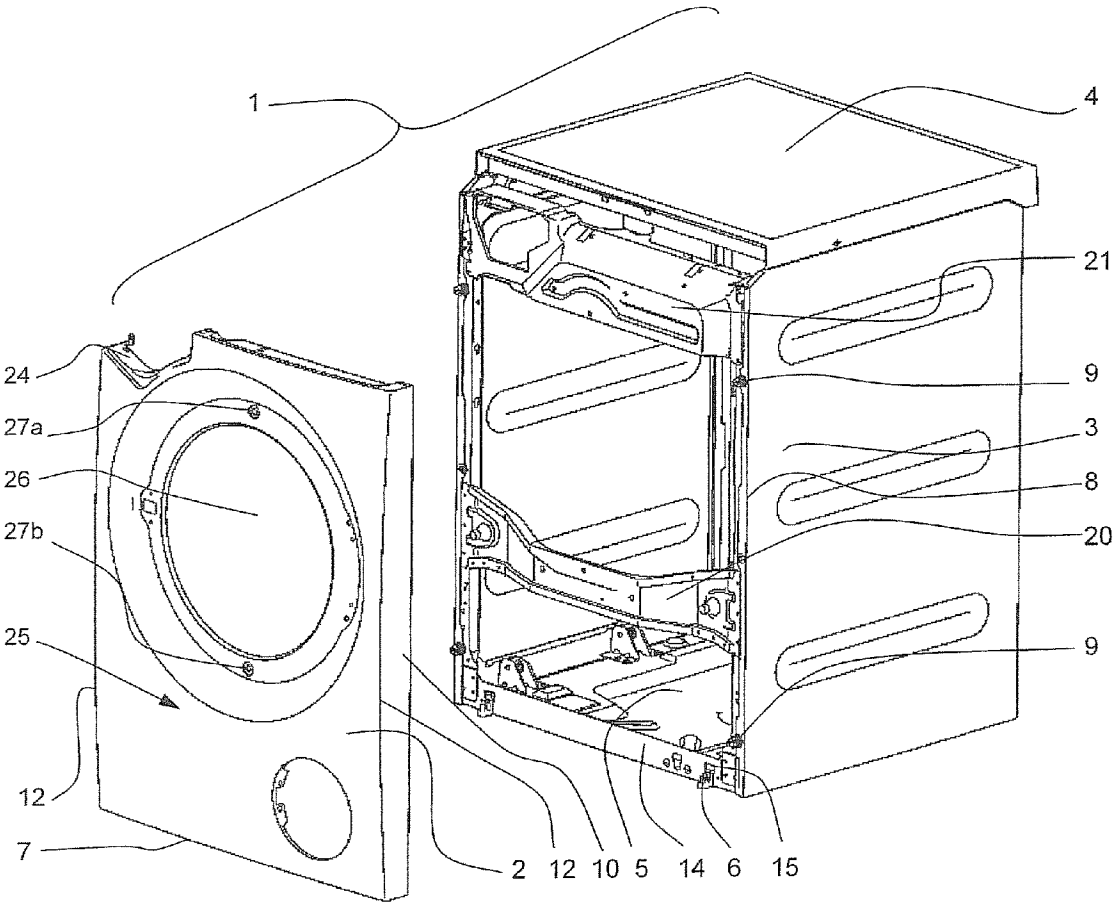
FIG. 1 is an exploded view of the washing machine housing according to the present invention.

One advantage that can be achieved with the present invention is that the housing, which includes a front wall, and two opposite lateral load-bearing members, is reinforced or stabilized in a simple manner. To this end, the front wall includes, at each of its lateral ends, a first rearwardly directed flange and, originating at said first flange, a second flange directed substantially parallel to the surface of the front wall. Each load-bearing member has disposed thereon at least one forwardly directed positioning element which extends into a corresponding opening in the second flange when in a fixed position. In the lower portion, the housing includes at least one supporting element which allows the front wall to be supported and fixed at the lower edge. Using these fastening and positioning means, the edge of the front wall is connected to the lateral load-bearing members at a plurality of locations, thereby preventing the front wall from vibrating and rattling. Another advantage is that the fixed front wall prevents twisting or parallel displacement of the load-bearing members in the front area. The load-bearing members used are, for example, load-bearing side walls, or load-bearing strips, for example, when the housing is configured as a frame having sheet-metal parts attached thereto.

In a suitable embodiment, a bottom member is disposed in the lower portion of the housing, the at least one supporting element for supporting and fixing the lower edge of the front wall being mounted to the front end of said bottom member. In this manner, a front wall extending to close to the bottom can be easily supported in the lower portion.

It is also advantageous to provide the bottom member with an upwardly directed flange at the front end thereof, and to provide this flange with an opening into which is inserted the at least one supporting element. This allows the supporting element to be manufactured as a separate part, independently of the bottom member, and to be attached to the bottom member in a simple manner.

When the housing is configured as a support frame having two front strips which act as supporting elements, it is convenient to attach the positioning elements to the front edges of the strips. In this housing design, it is advantageous to attach the separate side walls to the strip using the positioning element. To this end, the side wall includes a flange at its front edge, said flange abutting the front edge of the strip. The flange includes a bore through which protrudes the fastening means of the positioning element, the attachment of the side wall at the front being accomplished by the rear side of the positioning element pressing against the flange of the side wall.

It is convenient to design the at least positioning element as a sleeve having a bottom disposed at its end face. The bottom has formed therein a bore which serves for attachment of the positioning element to the front end of the load-bearing member or to the front face of the strip using a fastening means, such as a screw or rivet.

In an advantageous embodiment, the sleeve has axial slots, which permits elastic deformation of the segments remaining between the slots. When in a fixed position, the segments bear frictionally against the inner edge of the respective corresponding mounting opening in the front wall.

In another advantageous embodiment, the sleeve or the segments have an at least partially surrounding entry bevel provided on the exterior thereof at the forwardly directed end, said entry bevel enabling, or at least facilitating, at least partial insertion of the positioning element into the respective corresponding opening in the second flange of the front wall. During insertion, the segments are pressed together, as a result of which they exert a force on the inner edge of the opening. A latching edge extending at least partially around the peripheral surface segments on the exterior thereof enables snap-fitting in the corresponding opening in the front wall. In addition, the positioning element is thereby in a connected to the front wall in a form-locking manner.

In another advantageous embodiment, the lower, rearwardly directed flange of the front wall has upwardly directed depressions formed therein in the region of the openings. By arranging the lower mounting locations at an elevated position, the supporting elements can be disposed at a slightly elevated position. On the one hand, this simplifies the attachment of the supporting elements to the bottom plate or to the load-bearing members. On the other hand, the supporting elements are concealed by the front face of the fixed front wall.

In a further advantageous embodiment, the housing has a lower reinforcing plate at the front between the opposite load-bearing members, said lower reinforcing plate being disposed below the loading opening. The front wall includes a mounting bore in the area below the loading opening, said mounting hole serving for fixing the front wall to the lower reinforcing plate using a fastening means, such as a screw or a bayonet pin.

In a further advantageous embodiment, the housing has an upper reinforcing plate at the front between the opposite load-bearing members, said upper reinforcing plate being disposed above the loading opening. The front wall includes a mounting hole in the area above the loading opening, said mounting bore serving for fixing the front wall to the above reinforcing plate using a fastening means, such as a screw or a bayonet pin. This provides a particularly reliable and firm connection between the front wall and the supporting elements of the housing. The front wall can act as a load-bearing part, because it prevents twisting or parallel displacement of the load-bearing members in the front area. The stability of the housing is increased by simple means.

The housing 1 of a front-loading laundry appliance shown in FIG. 1 includes a bottom member 5 having two vertically upright lateral load-bearing members 3 and a front wall 2, whose lateral edges 12 abut front edges 8 of lateral load-bearing members 3 in the mounted position. A housing cover 4 is placed on the top edges of load-bearing members 3, closing housing 1 at the top. Housing 1 has supporting elements 6 mounted in the lower portion thereof, said supporting elements providing a support and fixation means for lower edge 7 of front wall 2. In the embodiment shown, the separately formed supporting elements 6 are mounted on front flange 14 of bottom member 5. Alternatively, supporting elements 6 can be disposed or mounted in the lower portion of front edges 8 of load-bearing members 3. Each load-bearing member 3 has a positioning element 9 disposed on front edge 8 in the lower portion thereof, said positioning element being in the form of a forwardly projecting pin. Each load-bearing member 3 has a further positioning element 9 disposed on front edge 8 in the upper portion thereof. An upper reinforcing plate 21 is mounted between front edges 8 of load-bearing members 3 in the upper portion, said reinforcing plate being located in the area above loading opening 26 and connecting the two opposite load-bearing members 3. A lower reinforcing plate 20 is mounted between front edges 8 of load-bearing members 3 in the lower third, said lower reinforcing plate being located in the area below loading opening 26 and connecting the two opposite load-bearing members 3. In the operational condition, front wall 2 is attached to these plates 20, 21 by screws. For screw mounting, front wall 2 has a bore **27*b* formed therein below loading opening 26 and a further bore 27*a* formed therein above the loading opening, said bores corresponding to a threaded bore in lower reinforcing plate 20 and to a threaded bore in upper reinforcing plate 21, respectively. The front wall has a tab cut and bent out of its upper flange 24. In the mounted position, said tab abuts the upper reinforcing plate 21 from the side. The attachment of front wall 2 in the upper portion is accomplished by one or more screws which are inserted and screwed into the reinforcing plate 21** located below through the tab.

Figure 2:
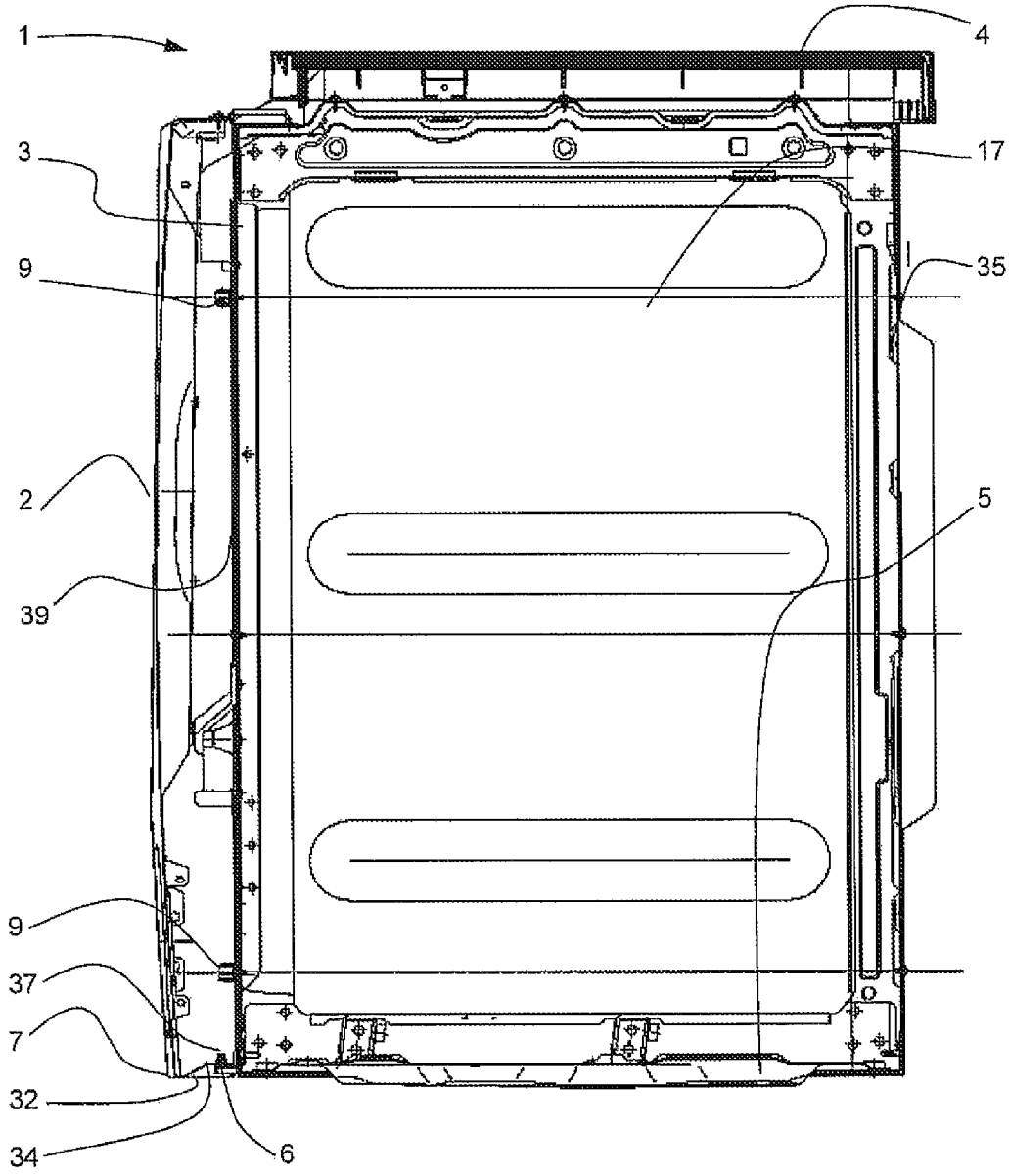
FIG. 2 is a side view of the housing.

FIG. 2 is a partially transparent side view showing housing 1 with the front wall 2 fixed. In this embodiment, the housing includes a bottom member 5, a rear wall 35, and two opposite vertical load-bearing members 3. The load-bearing members 3 used are self-supporting side walls which each have a flange at front edge 8. At front edges 8 of load-bearing members, there are mounted forwardly projecting positioning elements 9. Housing 1 has supporting elements 6 mounted in the lower portion thereof, said supporting elements having a forwardly extending segment 36 and an upwardly directed pin 37 originating at said forwardly extending segment. The directions indicated refer to the operational position of housing 1 or of the laundry appliance. A housing cover 4 rests on top edges 38 of lateral load-bearing members 3 and on the top edge of rear wall 35. Front wall 2 is provided, at its lateral edges, with a first flange 10 and, originating at said first flange, a second flange 11 extending substantially parallel to the surface 25 of front wall 2. The front wall is provided with a flange 32 at its lower edge, said flange having openings 33 into which extend the upwardly directed pins 37 of supporting elements 6. Second flange 11 has openings 13 corresponding to positioning elements 9. In the fixed position, the positioning elements protrude through said openings. In this manner, front wall 2 is positioned particularly accurately with respect to lateral load-bearing members 3, the visible first flange 10 being flush, over its entire extent, with the surface of the respective lateral load-bearing member 3 or side wall 17. There is only a narrow gap 39 of uniform width between front wall 2 and load-bearing member 3 or side wall 17. The front wall is provided at the top with an inwardly directed flange 24, which is located below, and screwed to, a tab cut and bent out of upper reinforcing plate 21.

Figure 3:
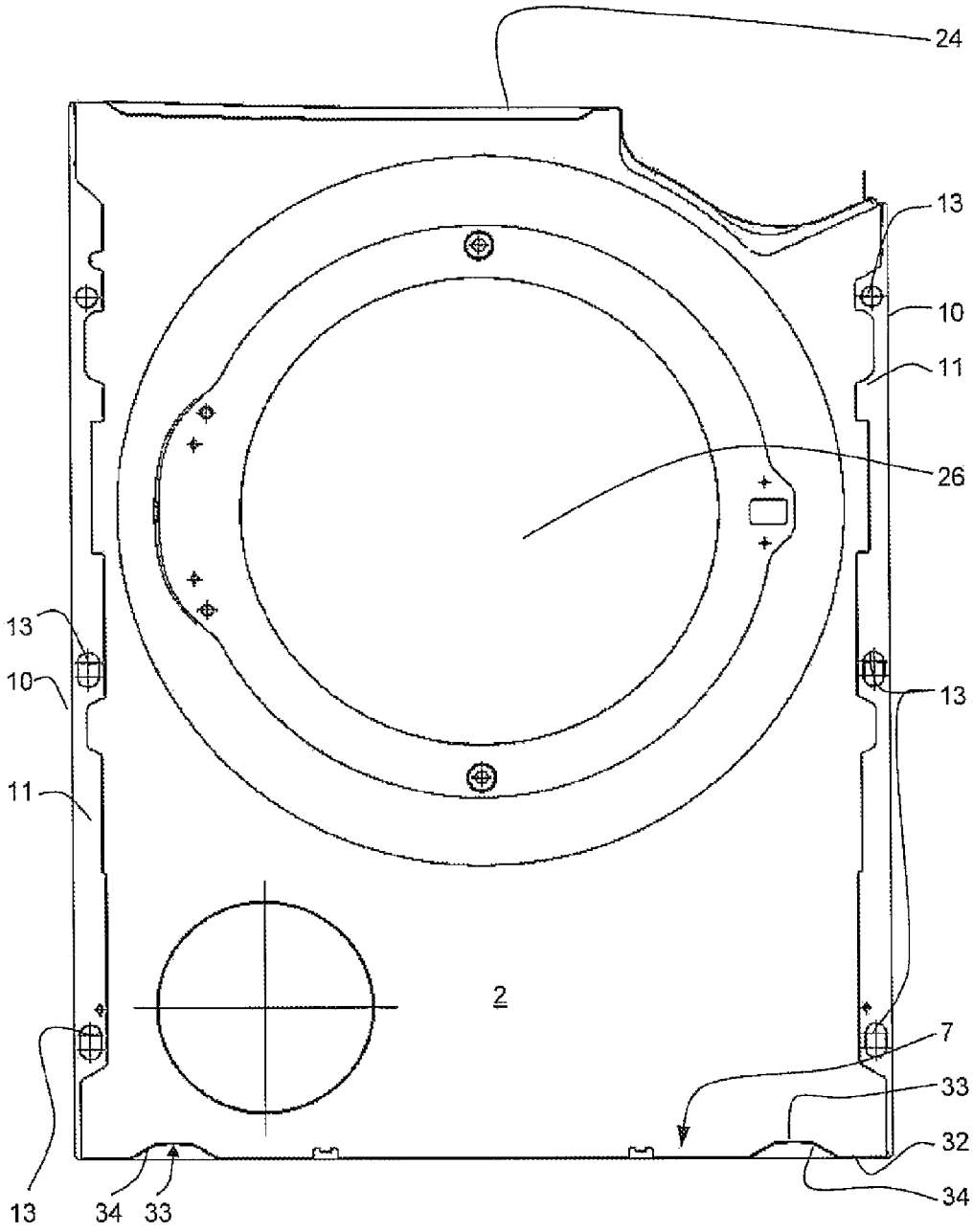
FIG. 3 is a rear view of the front wall.

In FIG. 3, front wall 2 is shown from an inside perspective. Shown here are upper flange 24, first lateral flange 10, second lateral flange 11, and lower flange 32. Loading opening 26 is located in the area of the center and extends into the upper third. On the outer side, a door, especially a porthole door, may be pivotally mounted at the lateral edge of loading opening 26. Openings 13 for receiving positioning elements 9 are provided in second flanges 11 of the respective lateral edges 12 in the lower, middle and upper portions thereof. Lower flange 32 has an upwardly directed indentation or depression 34 in the region of each of the receiving openings 33 for the pins 37 of supporting elements 6. Thus, receiving openings 33 are located higher than lower edge 7 of front wall 2.

Figure 4:
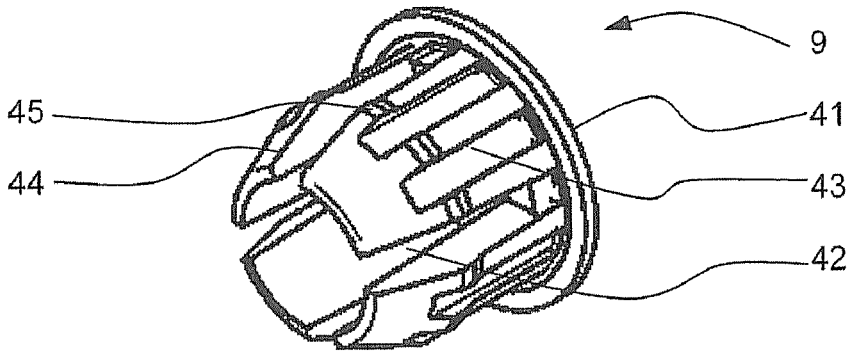
FIG. 4 is a detail view of a positioning element.

FIG. 4 shows sleeve-shaped positioning element 9 as a separate part. It is provided with a bottom 41 at its end face, said bottom having a bore for attachment to the front edge of load-bearing member 3 by means of a screw 40 or rivet. Positioning element 9 has axial slots 42, which permits elastic deformation of the segments 43 remaining between slots 42. When front wall 2 is in a fixed position, segments 43 bear frictionally against the inner edge of the respective corresponding mounting opening 13. Segments 43 of positioning element 9 have an at least partially surrounding entry bevel 44 provided on the exterior thereof at the forwardly directed end, said entry bevel enabling, or at least facilitating, at least partial insertion of positioning element 9 into the respective corresponding opening 13. During insertion, segments 43 are pressed together, as a result of which they exert a force on the inner edge of opening 13. A latching edge 45 extending at least partially around segments 43 on the exterior thereof enables snap-fitting in the corresponding opening 13 in front wall.

Figure 5:
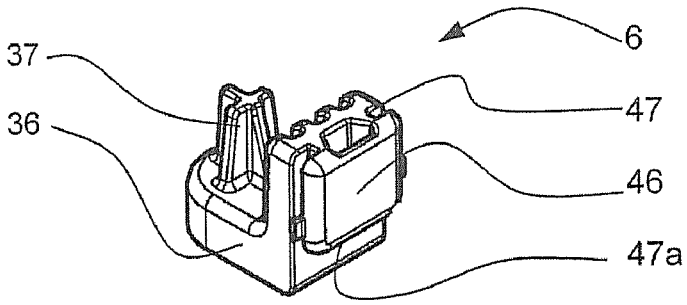
FIG. 5 is a detail view of a supporting element.

FIG. 5 shows supporting element 6 as a separate part. It is substantially hook-shaped, the forwardly directed segment 36 having integrally formed therewith an upwardly directed pin 37. Said segment is provided on the opposite side with a formation 46 having vertical lateral slots 47. In the inserted position, the edges of the openings 15 provided in flange 14 of bottom member 5 extend into said slots. In order to attach supporting element 6, initially, the rear formation 46 is inserted into the upper portion of opening 15. Then, supporting element 6 is pushed down into the narrower portion of opening 15, the lateral edges extending into lateral slots 47, and the lower edge of opening 15 extending into a lower transverse slot 47*a*. After that, supporting element 6 is firmly located on front flange 14 of bottom member 5.

Figure 6:
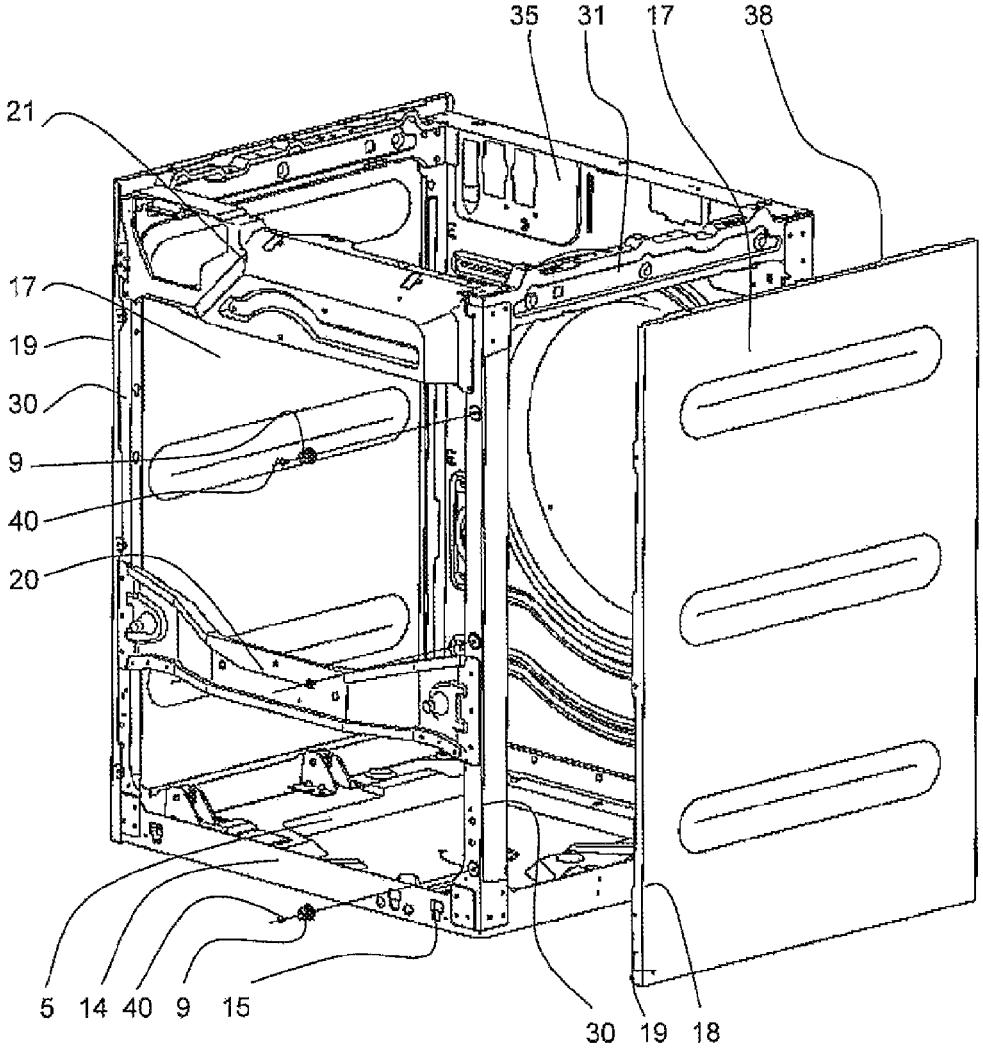
FIG. 6 is an exploded view of the housing having a support frame.

FIG. 6 is a view of a housing having a support frame. The load-bearing members 3 used are two substantially vertical strips 30 which are connected to rear wall 25 by horizontal strips 31. On each side, a side wall 17 is positioned against and attached to these strips and to the lateral edge of rear wall 35. Side wall 17 is provided at its front edge 18 with a flange 19 which, in conjunction with bores, is used for attachment to the respective strip 30. Flange 19 abuts the front face of strip 30, positioning element 9 at least partially resting against this flange 19. Positioning element 9 is attached to strip 30 using a fastening means, such as a screw 40, thereby at the same time attaching the flange 19, and thus side wall 17, to strip 30. In this embodiment, an upper reinforcing plate 21 and a lower reinforcing plate 20 are disposed in the front portion of housing 1 between strips 30, which act as load-bearing members, said upper reinforcing plate being mounted closely above loading opening 26 and said lower reinforcing plate 20 being mounted closely below loading opening 26. Reinforcing plates 20, 21 serve to increase the stability of housing 1 and are used for attachment of front wall 2 in the area near loading opening 26 by means of screw connections. A tab 29 is cut and bent out of upper reinforcing plate 21, said tab extending closely above upper flange 24 of the front wall 2 positioned against strips 30. Front door 2 is secured or attached by screw connections through the tab into flange 24 located therebelow.

What is claimed is:

1. A housing for a front-loading laundry appliance, the housing comprising:

a front wall including a loading opening for loading laundry, a first surface and a first and a second lateral edge, and, at each of the first and second lateral edges, a respective first rearwardly directed flange and a respective second flange originating at the respective first flange and extending substantially parallel to the first surface;

a first and a second opposite lateral load-bearing member, the first lateral load-bearing member abutting the first lateral edge of the front wall and the second lateral load-bearing member abutting the second lateral edge of the front wall when the front wall is in a fixed position;

a first supporting element disposed in a lower portion of the housing and configured to provide a support for fixing the front wall at a lower edge thereof, the first supporting element being separable from the front wall and the lower portion of the housing, the first supporting element including a forward extending segment extending toward the first surface of the front wall, an upwardly directed pin disposed on the forward extending segment, and at least two intersecting slots disposed at an angle with respect to one another and configured to slidably receive an edge of an opening in the lower portion of the housing so as to attach the first supporting element to the housing; and a respective forwardly projecting positioning element disposed above the first supporting element in a vicinity of a front end of each of the first and second lateral load bearing members;

wherein each of the respective second flanges of the front wall includes a respective first opening receiving a respective one of the positioning elements, wherein the front wall includes a lower edge and a second rearwardly directed flange, the second rearwardly directed flange having an upwardly directed depression and a second opening disposed in the upwardly directed depression, wherein the forward extending segment of the first supporting element is disposed in the upwardly directed depression such that the first supporting element is disposed above the lower edge and the second opening receives the upwardly directed pin of the first supporting element.

2. The housing as recited in claim 1 wherein the front-loading laundry appliance includes at least one of a washing machine, a washer-dryer machine, and a laundry dryer.

3. The housing as recited in claim 1 further comprising a bottom member disposed in the lower portion of the housing, the first supporting element being mounted to a front end of the bottom member.

4. The housing as recited in claim 3 wherein the bottom member includes a third upwardly directed flange at a front end thereof, the third upwardly directed flange including a third opening receiving the first supporting element.

5. The housing as recited in claim 1 wherein the first lateral load-bearing member is a first front strip and the second lateral load-bearing member is a second front strip, a first of the respective positioning elements being attached to a front edge of the first strip, and a second of the respective positioning elements being attached to a front edge of the second strip.

6. The housing as recited in claim 1 wherein the first lateral load-bearing member is a first side wall at a first lateral side of the housing and the second lateral load-bearing member is a second side wall at a second lateral side of the housing, the first side wall including a fourth front flange at a front edge thereof, the second side wall including a fifth front flange at a front edge thereof, the front wall being attachable to the fourth front flange with a first positioning element, the front wall being attachable to the fifth front flange with a second positioning element.

7. The housing as recited in claim 1 wherein each of the respective positioning elements includes a sleeve having a bottom disposed at an end face thereof, the bottom including a bore attached to a respective front end of a respective one of the first and second lateral load-bearing members by a respective fastening device.

8. The housing as recited in claim 7 wherein the sleeve includes a plurality of axial slots and segment portions disposed in an alternating fashion, the slots permitting elastic deformation of the segments.

9. The housing as recited in claim 7 wherein each of the segments includes an at least partially surrounding entry bevel at an exterior and forwardly directed end thereof, the entry bevel enabling at least partial insertion of the respective positioning element into the respective opening in the respective second flange of the front wall.

10. The housing as recited in claim 8 wherein each of the segments includes an at least partially surrounding entry bevel at an exterior and forwardly directed end thereof, the entry bevel enabling at least partial insertion of the respective positioning element into the respective opening in the respective second flange of the front wall.

11. The housing as recited in claim 7 wherein each of the segments includes an at least partially surrounding latching edge at an exterior thereof and enabling snap-fitting with a respective edge in a respective opening of the front wall.

12. The housing as recited in claim 8 wherein each of the segments includes an at least partially surrounding latching edge at an exterior thereof and enabling snap-fitting with a respective edge in a respective opening of the front wall.

13. The housing as recited in claim 1 further comprising a loading opening and a lower reinforcing plate disposed between the first and second lateral load-bearing members and below the loading opening, and wherein the front wall includes a mounting bore disposed in an area below the loading opening and fixing the front wall to the lower reinforcing plate using a fastening device.

14. The housing as recited in claim 1 further comprising a loading opening and an upper reinforcing plate disposed between the first and second lateral load-bearing members and above the loading opening, and wherein the front wall includes a mounting bore disposed in an area above the loading opening and fixing the front wall to the upper reinforcing plate using a fastening device.

15. The housing as recited in claim 1 wherein the first supporting element provides an intermediary connection between the front wall and the lower portion of the housing.

16. The housing as recited in claim 1 wherein the first supporting element is separable from the front wall and the lower portion of the housing.

17. A housing for a front-loading laundry appliance, the housing comprising:

a front wall including a loading opening for loading laundry, a first surface and a first and a second lateral edge, and, at each of the first and second lateral edges, a respective first rearwardly directed flange and a respective second flange originating at the respective first flange and extending substantially parallel to the first surface;

a first and a second opposite lateral load-bearing member, the first lateral load-bearing member abutting the first lateral edge of the front wall and the second lateral load-bearing member abutting the second lateral edge of the front wall when the front wall is in a fixed position;

a first supporting element disposed in a lower portion of the housing and configured to provide a support for fixing the front wall at a lower edge thereof, the first supporting element being separable from the front wall and the lower portion of the housing, the first supporting element including at least two intersecting slots disposed at an angle with respect to one another and configured to slidably receive an edge of an opening in the lower portion of the housing so as to attach the first supporting element to the housing; and a respective forwardly projecting positioning element disposed above the first supporting element in a vicinity of a front end of each of the first and second lateral load bearing members;

wherein each of the respective second flanges of the front wall includes a respective first opening receiving a respective one of the positioning elements, wherein the front wall includes a second rearwardly directed flange, the second rearwardly directed flange having a second opening, wherein the second opening receives the first supporting element.

18. The housing as recited in claim 17 wherein the first supporting element has a formation for connecting the first supporting element to the lower portion of the housing, and the first supporting element has a forward extending segment extending toward the first surface of the front wall and an upwardly directed pin disposed on the forward extending segment for connecting the first supporting element to the front wall.

* * * * *